US006682246B2

(12) United States Patent
Reggiani

(10) Patent No.: US 6,682,246 B2
(45) Date of Patent: Jan. 27, 2004

(54) CONTAINER-APPLICATOR FOR FLUID PRODUCTS PARTICULARLY FOR COSMETIC OR PHARMACEUTICAL USE

(76) Inventor: Fulvio Reggiani, Via Boccaccio, 25, 21049 Tradate (IT)

( * ) Notice: Subject to any disclaimer, the term of this patent is extended or adjusted under 35 U.S.C. 154(b) by 0 days.

(21) Appl. No.: 10/184,975

(22) Filed: Jul. 1, 2002

(65) Prior Publication Data

US 2003/0170067 A1 Sep. 11, 2003

(30) Foreign Application Priority Data

Mar. 8, 2002 (IT) ..... MI2002A0494

(51) Int. Cl.[7] ..... A47L 13/30; B43K 5/00; B43M 11/06

(52) U.S. Cl. ..... 401/264; 401/205; 401/206; 401/207; 401/183; 401/186

(58) Field of Search ..... 401/205, 206, 401/207, 263, 264, 265, 266, 183, 186, 184, 185

(56) References Cited

U.S. PATENT DOCUMENTS

| | | | | | |
|---|---|---|---|---|---|
| 2,197,052 | A | * | 4/1940 | Lowen | 401/263 |
| 2,742,660 | A | * | 4/1956 | Van Esley | 401/205 |
| 2,820,234 | A | * | 1/1958 | Rigney | 401/186 |
| 4,008,968 | A | * | 2/1977 | Hobbs | 401/207 |
| 5,597,255 | A | * | 1/1997 | Yager et al. | 401/205 |
| 6,543,954 | B2 | * | 4/2003 | Owings | 401/185 |

* cited by examiner

*Primary Examiner*—David J. Walczak
(74) *Attorney, Agent, or Firm*—Guido Modiano; Albert Josif; Daniel O'Byrne

(57) ABSTRACT

A container-applicator for fluid products, particularly for cosmetic and pharmaceutical use, comprising, at the mouth of a container body, an applicator provided with a spongy matrix body that can be extracted for washing and is arranged proximate to a passage for connection to the inside of the container body. The passage for connection to the inside of the container body is controlled by a valve element that can be operated from the outside of the container body.

3 Claims, 8 Drawing Sheets

CONTAINER-APPLICATOR FOR FLUID PRODUCTS PARTICULARLY FOR COSMETIC OR PHARMACEUTICAL USE

BACKGROUND OF THE INVENTION

The present invention relates to a container-applicator for fluid products, particularly for cosmetic and pharmaceutical use.

It is known that several kinds of containers for fluid products used for cosmetic or pharmaceutical applications are currently commercially available; considering in particular products such as foundation cream, these containers currently have a dispensing hole from which the product flows out due to the pressure applied by the user to the body of the container, so as to apply the selected amount of product on the hand.

The product must then be applied by massaging onto the skin, with two kinds of drawbacks that substantially consist in the unavoidable waste of product and by the fact that the user necessarily has to get his/her hands dirty.

Moreover, another drawback that can be ascribed to prior art solutions is constituted by the fact that it is relatively difficult to achieve controlled and dosed dispensing of the product, thus leading to further waste.

SUMMARY OF THE INVENTION

The aim of the present invention is to eliminate the above mentioned drawbacks by providing a container-applicator for fluid products, particularly for cosmetic and pharmaceutical use, that allows to contain and apply any kind of emulsion, suspension or mixture, with the possibility to transfer it onto the skin without direct manual contact.

Within this aim, an object of the present invention is to provide a container-applicator that is capable, in practice, of filtering the product and gradually releasing it.

Another object of the invention is to provide a container-applicator that allows to automate the application of any cosmetic or pharmaceutical product, with more uniform application.

Another object of the invention is to provide a container-applicator that thanks to its particular constructive characteristics is capable of giving the greatest assurances of hygiene in application and safety in use.

Another object of the invention is to provide a container-applicator that can be obtained easily starting from commonly commercially available elements and materials and is further competitive from a merely economical standpoint.

This aim and these and other objects that will become better apparent hereinafter are achieved by a container-applicator for fluid products, particularly for cosmetic and pharmaceutical use, according to the invention, characterized in that it comprises, at the mouth of a container body, an applicator provided with a spongy matrix body that is arranged proximate to a passage for connection to the inside of the container body that is controlled by a valve element that can be operated from the outside of the container body.

BRIEF DESCRIPTION OF THE DRAWINGS

Further characteristics and advantages of the present invention will become better apparent from the following detailed description of some preferred but not exclusive embodiments of a container-applicator for fluid products, particularly for cosmetic and pharmaceutical use, illustrated only by way of non-limitative example in the accompanying drawings, wherein.

DESCRIPTION OF THE PREFERRED EMBODIMENTS

Figure 1:
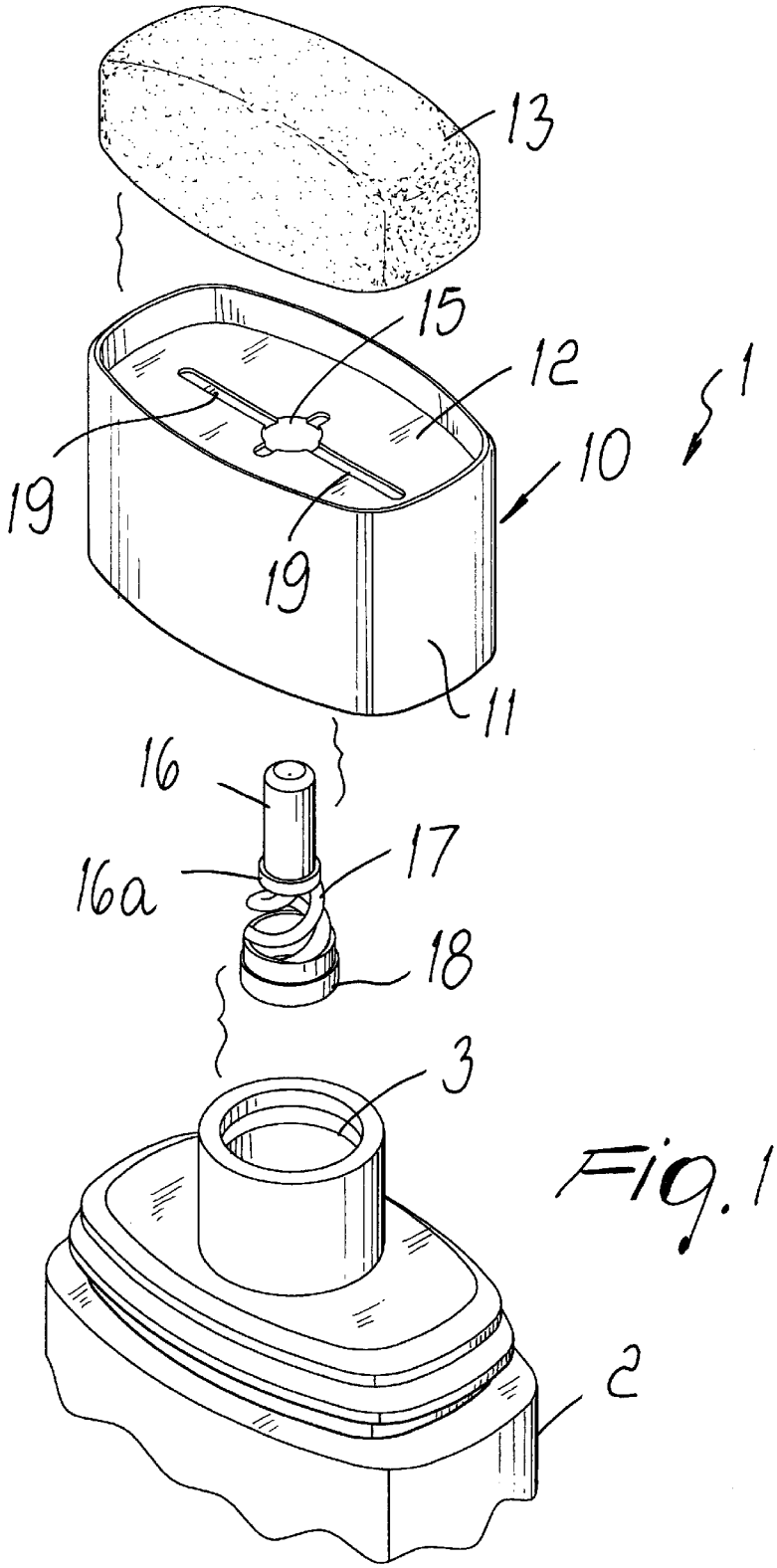
FIG. 1 is a schematic exploded perspective view of a first embodiment of the container.

A first embodiment of a container-applicator for fluid products, generally designated by the reference numeral 1 and particularly usable for cosmetic and pharmaceutical products, is described with reference to the figures and particularly to FIGS. 1 to 3.

The container has a container body 2 that forms a mouth 3 in which an applicator, generally designated by the reference numeral 10, is placed.

The applicator 10 has a cap 11 that couples to the mouth 3 by means of snap-acting means and has, in an upward region, a seat 12 in which a spongy-matrix body is inserted; such spongy-matrix body is provided by a glued sponge 13 that is applied to the seat 12.

The spongy-matrix body can be made of sponge, latex or polyurethane, flocked material, nylon, or other synthetic fabric, with a covering of natural fabric and in any case of any material that allows the diffusion of a fluid product.

The seat 12 forms centrally a passage 15 for connection to the inside of the container body that is controlled by a valve element constituted by a piston 16 that is pushed by a spring 17 that protrudes from a collar 18 inserted in the mouth 3.

The piston 16 can move in contrast with, and by way of the action of, the spring 17, and is provided with a flange **16*a* that forms the seal and can be moved away from the passage by pressure applied to the glued sponge 13 so that the product, from the inside of the container body 2**, can spread inside the spongy-matrix body and be easily applied from there.

Moreover, recessed channels 19 are provided on the bottom of the seat 12 and facilitate a more uniform distribution of the product inside the glued sponge 13.

Figure 4:
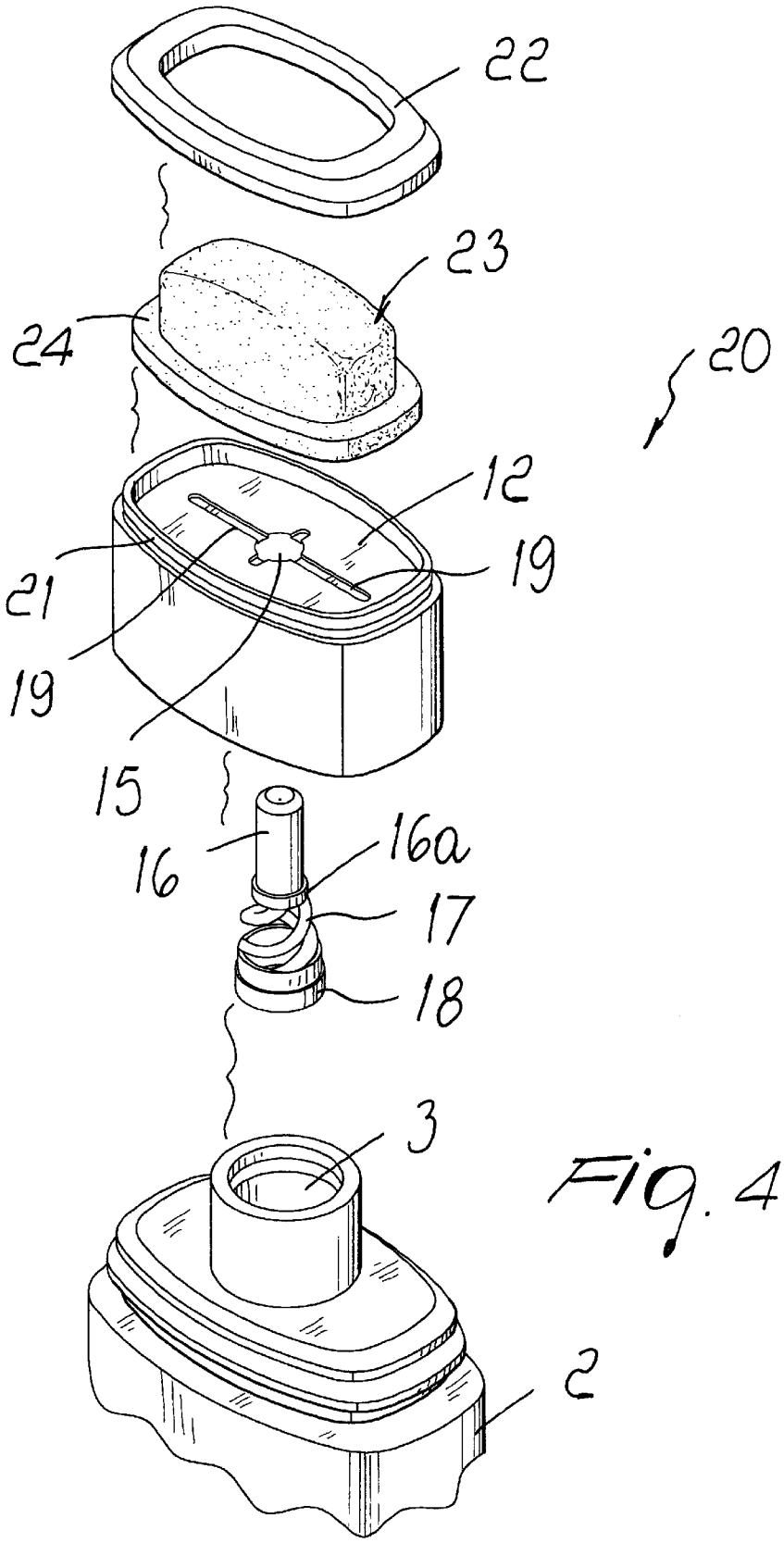
FIG. 4 is an exploded perspective view of a second embodiment of the container.
Figure 5:
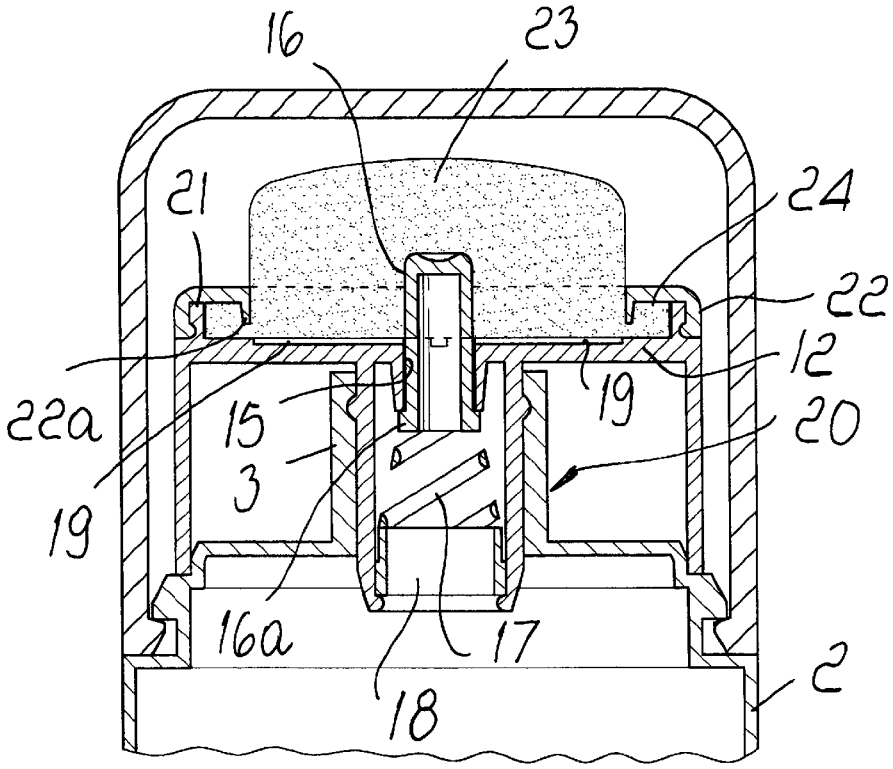
FIG. 5 is a sectional view of the container of FIG. 4.
Figure 6:
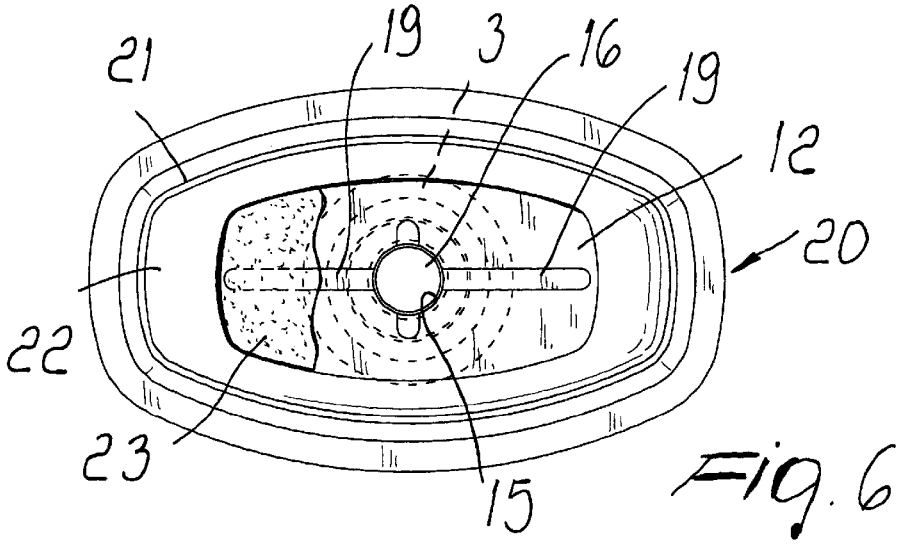
FIG. 6 is a top view of the container, with the spongy-matrix body removed.

FIGS. 4 to 6 illustrate an applicator, designated by the reference numeral 20, that is conceptually similar to the preceding one, with the difference that the seat 12 is delimited by a rim 21 on which it is possible to position a frame 22 that retains a spongy-matrix body, constituted by a flanged sponge 23 having a perimetric flange 24 that is retained in position by a circumferential edge 22*a* of the frame 22 that is applied by snap action to the body of the applicator.

Figure 2:
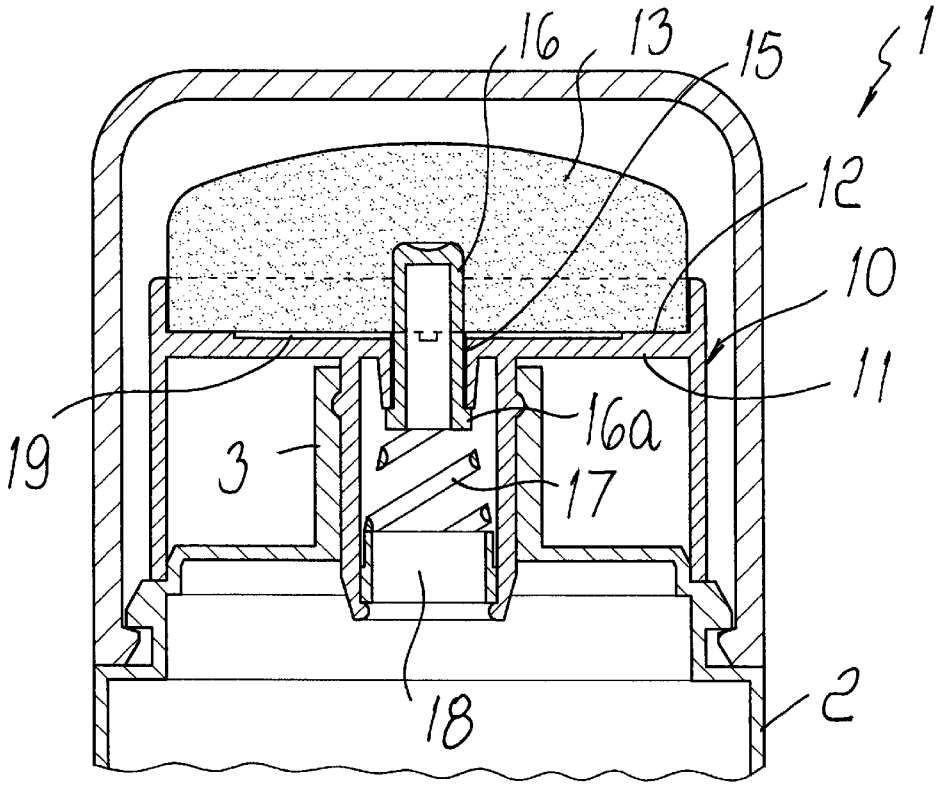
FIG. 2 is a sectional view of the container of FIG. 1.
Figure 3:
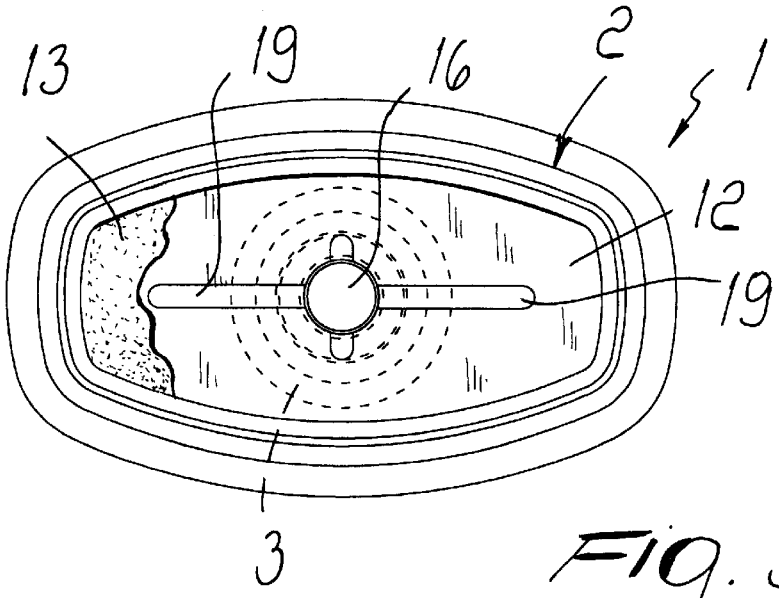
FIG. 3 is a top view of the container, with the spongy-matrix body removed.

In this case also there is a valve element that is similar to the one shown in FIGS. 1 to 3 and is designated by the same reference numerals.

Figure 7:
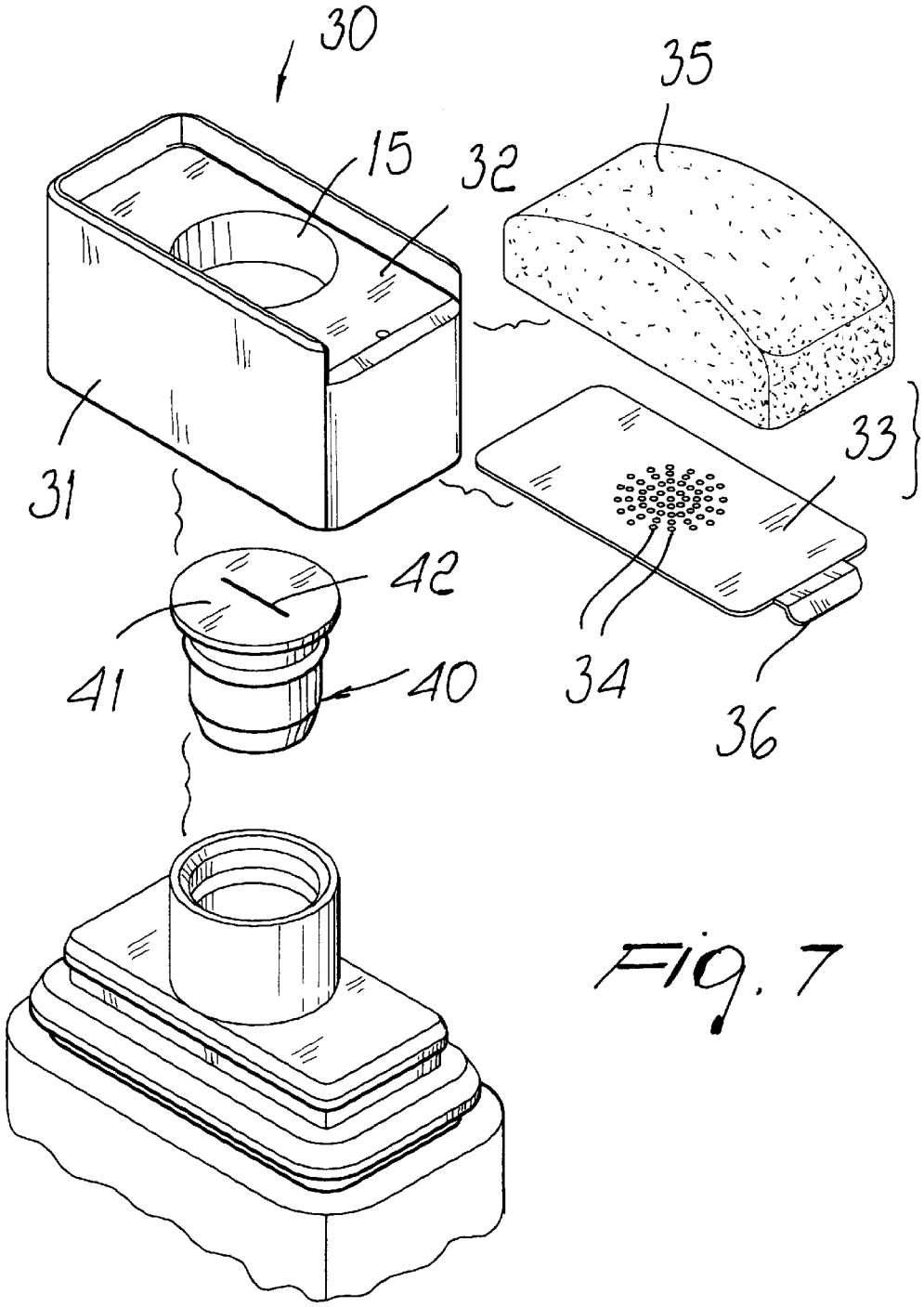
FIG. 7 is a schematic exploded perspective view of a third embodiment of the container-applicator.
Figure 8:
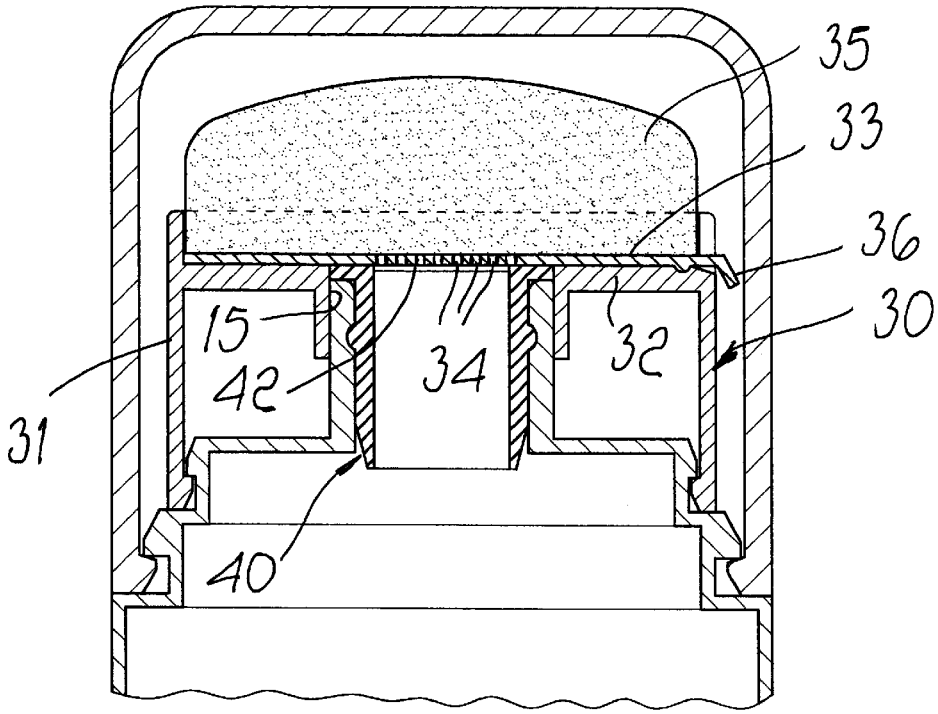
FIG. 8 is a sectional view of the container-applicator of FIG. 7.
Figure 9:
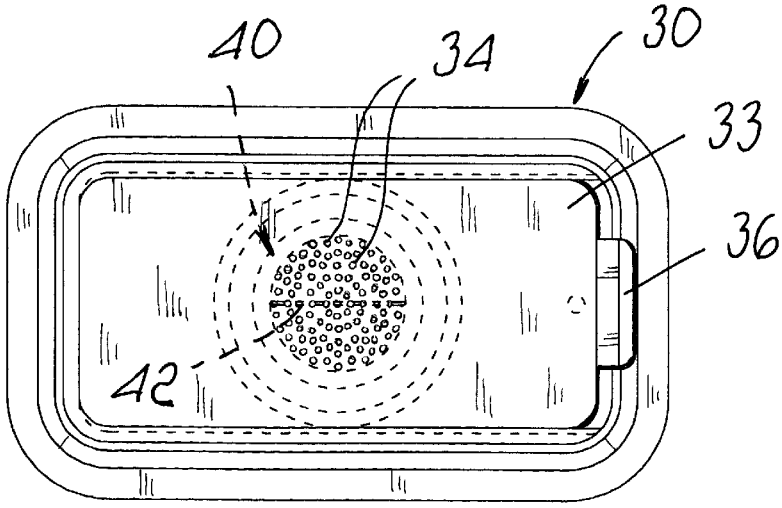
FIG. 9 is a plan view of the container, with the spongy-matrix body removed.
Figure 10:
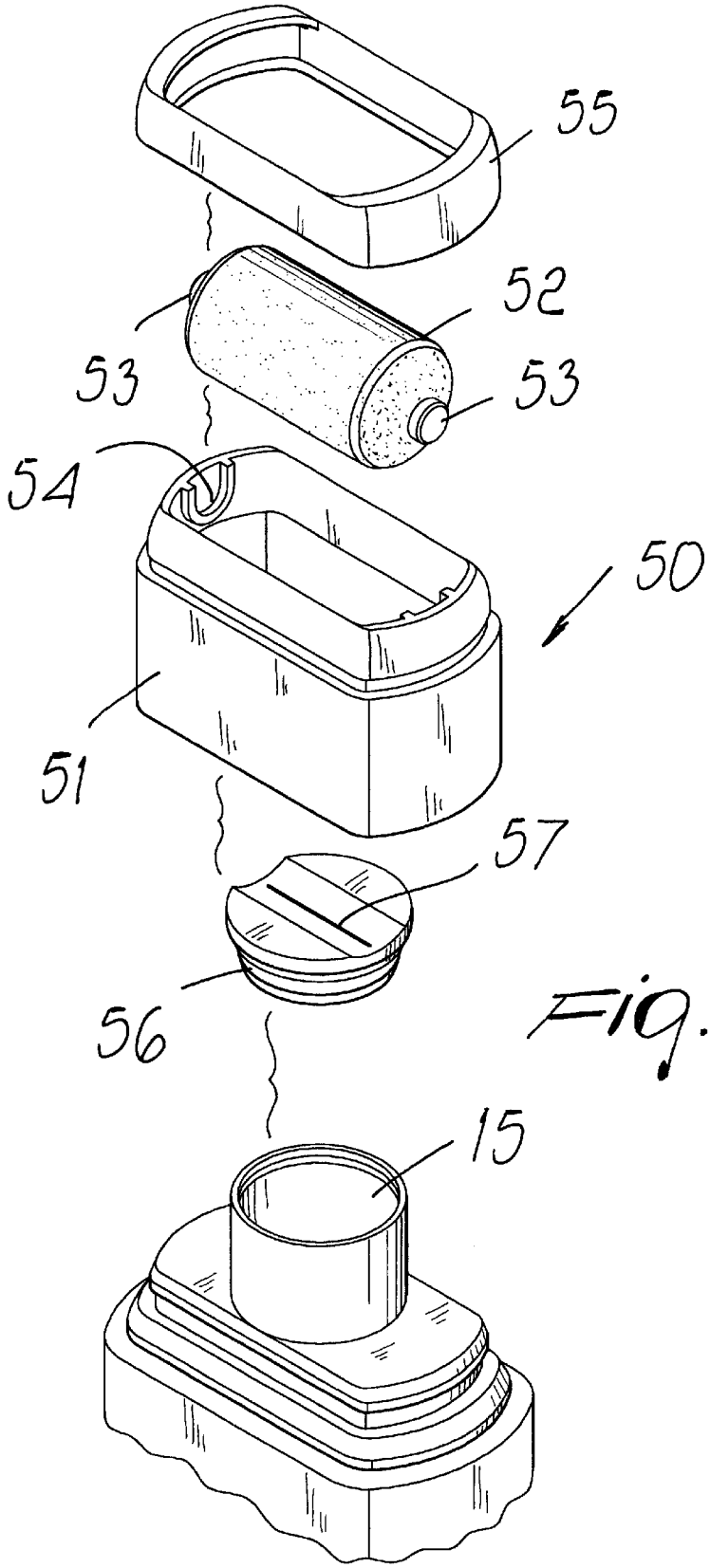
FIG. 10 is a schematic exploded perspective view of a fourth embodiment of the container-applicator.
Figure 11:
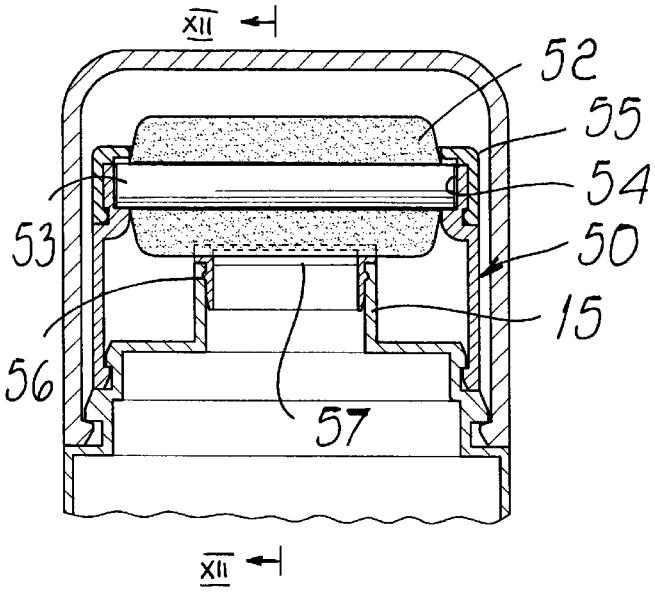
FIG. 11 is a sectional view of the container of FIG. 10.
Figure 12:
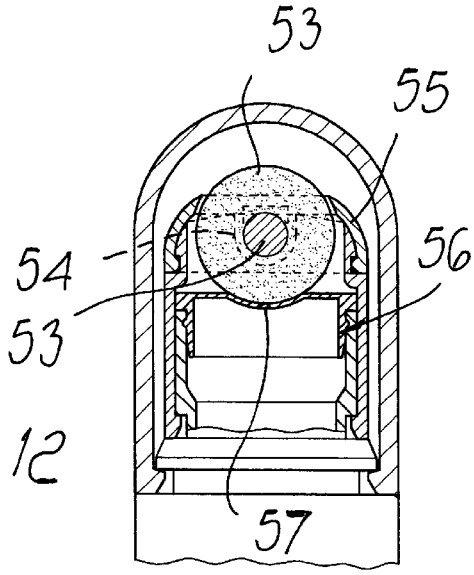
FIG. 12 is a sectional view, taken along the line XII—XII of FIG. 11.
Figure 13:
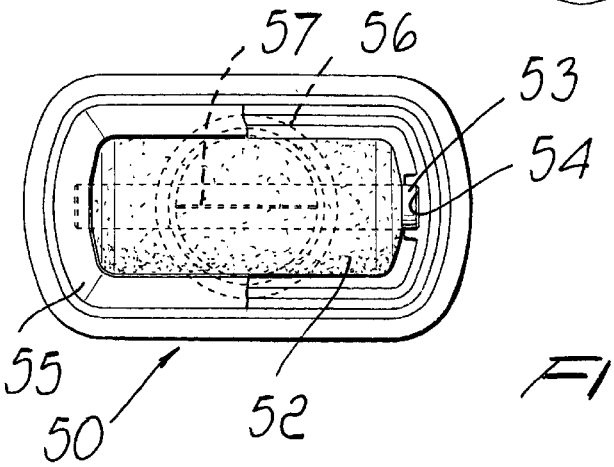
FIG. 13 is a schematic plan view of the container.

With reference to FIGS. 7 to 9, a different embodiment is illustrated in which there is an applicator 30 provided with a contoured cap 31 that defines a drawer-like seat 32 in which it is possible to slidingly insert a plate 33 that is provided with holes 34 and supports a removable sponge 35.

The plate 33, which is provided with the grip tab 36, can be inserted in the seat 32 where the passage 15 for connection to the inside of the container is located.

A valve element can be arranged in the passage 15 and is constituted by a plug, designated by the reference numeral 40, which is closed in an upward region by an elastic membrane 41 provided with a diametrical slit 42 that provides in practice an elastic closure of the container body but allows, by applying pressure from the outside, to open the valve, consequently allowing the passage of the product onto the removable sponge 35.

Another embodiment is described with reference to FIGS. 10 to 13; in this embodiment, the applicator, designated by the reference numeral 50, has a supporting body 51 with which a roller-like spongy-matrix body 52 can engage rotatably; such body is provided with a rotation shaft 53 that can be inserted in saddle-shaped portions 54 formed by the supporting body.

The roller 52 is kept in position by means of a perimetric frame 55 that is applied to the body 51 in order to keep the roller in position.

At the passage for connection to the container body, again designated by the reference numeral 15, a valve element is provided by means of a saddle-shaped elastic plug 56 which has, at the saddle-shaped region, a slit 57 provided in an elastically flexible membrane that acts as a valve element by remaining closed in normal conditions and allowing instead the passage of the fluid product when pressure is applied to the container.

In practice, the fluid product is picked up by the roller 52, which allows easy application to the skin of the user.

With the above described arrangement, therefore, a container-applicator is provided that allows to apply directly the product, be it foundation cream or any other product deemed appropriate, allowing to distribute it easily on the skin and to apply it uniformly and without dirtying one's hands.

Another important aspect to be noted is that the spongy-matrix body is applied detachably, thus allowing to clean it easily, since the spongy-matrix body can be removed to be washed and then reapplied to the container-applicator.

From the above description it is thus evident that the invention achieves the intended aim and objects, and in particular the fact is stressed that a container-applicator is provided which allows to automate the application of any fluid product, be it cosmetic or pharmaceutical, allowing application at any time and in any situation without having to intervene with manual massage on the skin.

The invention thus conceived is susceptible of numerous modifications and variations, all of which are within the scope of the appended claims.

All the details may further be replaced with other technically equivalent elements.

In practice, the materials used, as well as the contingent shapes and dimensions, may be any according to requirements.

The disclosures in Italian Patent Application No. MI2002A000494 from which this application claims priority are incorporated herein by reference.

What is claimed is:

1. A container-applicator for fluid products, comprising a container body having a mouth; an applicator arranged at the mouth of the container body; a passage provided in said applicator and connecting inside of said container body; a valve element for controlling said passage, said valve element being operatable from outside said container body; and a spongy matrix body that is arranged proximate to said passage, and further comprising a plate provided with holes which supports said spongy-matrix body constituted by a removable sponge, said plate being arranged in direct contact with said valve element, above said valve element.

2. The container-applicator of claim 1, (comprising a plate provided with holes which supports said spongy-matrix body constituted by a removable sponge), wherein said applicator (comprising) further comprises a contoured cap that forms a drawer-like seat for sliding insertion of said plate.

3. The container-applicator of claim 2, wherein said valve element is constituted by a plug that is insertable in said passage and by an elastic membrane provided with a diametrical slit which closes said plug in an upward region thereof.

* * * * *